US012071743B2

(12) United States Patent
Kushner

(10) Patent No.: US 12,071,743 B2
(45) Date of Patent: Aug. 27, 2024

(54) COORDINATED ACTUATOR CONTROL BY AN OPERATOR CONTROL

(71) Applicant: Caterpillar Inc., Peoria, IL (US)

(72) Inventor: Jeremy Kushner, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 953 days.

(21) Appl. No.: 17/086,126

(22) Filed: Oct. 30, 2020

(65) Prior Publication Data

US 2022/0136203 A1 May 5, 2022

(51) Int. Cl.

| | |
|---|---|
| ***E02F 3/42*** | (2006.01) |
| ***E02F 3/34*** | (2006.01) |
| ***E02F 3/76*** | (2006.01) |
| ***E02F 3/84*** | (2006.01) |
| ***E02F 3/96*** | (2006.01) |
| ***E02F 9/20*** | (2006.01) |
| *E02F 9/22* | (2006.01) |

(52) U.S. Cl.

CPC ..... *E02F 3/96* (2013.01); *E02F 3/3414* (2013.01); *E02F 3/422* (2013.01); *E02F 3/7609* (2013.01); *E02F 3/844* (2013.01); *E02F 9/2004* (2013.01); *E02F 9/2025* (2013.01); *E02F 9/2203* (2013.01)

(58) Field of Classification Search

CPC ..... E02F 3/3414; E02F 3/422; E02F 3/7609; E02F 3/844; E02F 9/2004; E02F 9/2025; E02F 9/2203

See application file for complete search history.

(56) References Cited

U.S. PATENT DOCUMENTS

| | | | | |
|---|---|---|---|---|
| 3,038,268 A | | 6/1962 | Richier | |
| 3,703,931 A | * | 11/1972 | Page | F15B 21/087 37/348 |
| 5,584,346 A | | 12/1996 | Komatsu | |
| 6,047,228 A | | 4/2000 | Stone et al. | |
| 6,152,239 A | * | 11/2000 | Kelley | E02F 9/2025 74/523 |
| 7,546,729 B2 | | 6/2009 | Palmer et al. | |
| 7,588,088 B2 | * | 9/2009 | Zachman | E02F 3/765 701/50 |

(Continued)

FOREIGN PATENT DOCUMENTS

| | | | |
|---|---|---|---|
| GB | 665922 | A | 2/1952 |
| JP | 2005146738 | A | 6/2005 |

(Continued)

OTHER PUBLICATIONS

Written Opinion and International Search Report for Int'l. Patent Appln. No. PCT/US2021/053324, mailed Jan. 11, 2022 (11 pgs).

*Primary Examiner* — Gary S Hartmann

(57) ABSTRACT

In some implementations, an implement control system includes an operator control configured for manipulation in one or more motions and a controller. The controller may be configured to, based on a particular motion of the one or more motions, cause actuation of one or more first actuators, configured to selectively raise or lower a first lateral side of a work implement of a machine, and one or more second actuators, configured to selectively raise or lower a second lateral side of the work implement, in tandem. The one or more first actuators and the one or more second actuators may be controlled by independent control systems.

20 Claims, 3 Drawing Sheets

(56) References Cited

U.S. PATENT DOCUMENTS

| | | | | |
|---|---|---|---|---|
| 8,453,783 | B2 * | 6/2013 | Hamkins | E02F 9/2228 180/306 |
| 9,085,877 | B2 * | 7/2015 | Wahlmark | E02F 3/764 |
| 9,771,705 | B2 * | 9/2017 | Horstman | E02F 9/2203 |
| 9,777,460 | B2 * | 10/2017 | Wuisan | E02F 3/764 |
| 9,777,461 | B2 | 10/2017 | Wuisan et al. | |
| 9,797,114 | B2 * | 10/2017 | Maifield | E02F 9/2012 |
| 10,472,798 | B2 * | 11/2019 | Sherlock | E02F 9/2025 |
| 10,865,542 | B2 * | 12/2020 | Smith | E02F 3/432 |
| 10,926,795 | B2 * | 2/2021 | Iwamura | B62D 11/06 |
| 11,505,920 | B2 * | 11/2022 | Sherlock | E02F 9/2041 |
| 11,686,067 | B2 * | 6/2023 | Veasy | E02F 3/7645 701/50 |
| 2002/0166267 | A1 * | 11/2002 | McGugan | E02F 9/2004 37/348 |
| 2016/0153166 | A1 | 6/2016 | Gentle et al. | |
| 2017/0145655 | A1 | 5/2017 | Mason | |
| 2023/0116078 | A1 * | 4/2023 | Holl | E02F 3/7645 172/1 |
| 2023/0132898 | A1 * | 5/2023 | Rawlins | E02F 3/248 172/1 |

FOREIGN PATENT DOCUMENTS

| | | | |
|---|---|---|---|
| JP | 2008270017 | A | 11/2008 |
| JP | 2012017589 | A | 1/2012 |
| WO | 2015190631 | W | 12/2015 |

* cited by examiner

COORDINATED ACTUATOR CONTROL BY AN OPERATOR CONTROL

TECHNICAL FIELD

The present disclosure relates generally to an implementation control system and, for example, to coordinated actuator control by an operator control.

BACKGROUND

Compact construction machines (for example, skid steer loaders or compact track loaders) are commonly used where working space is limited. These machines may include a bucket attachment for applications ranging from asphalt milling to earth moving. For certain applications, the bucket attachment of a machine may be replaced with another work implement, such as a grader blade attachment. A grader blade may be conventionally controlled using separate joysticks that independently control raising or lowering a right-side and a left-side of the grader blade. However, a compact construction machine may not be equipped with controls that allow for control of a grader blade in the conventional manner. Accordingly, while operator controls for the machine may be suitable for controlling the bucket attachment, in some applications, it may be difficult to control the grader blade attachment using the operator controls.

Great Britain Patent No. 665,922 (the '922 patent) to Eastern Steel Products Limited discloses hydraulically-operated equipment, such as snow plows and grader blades, that can be fitted to and removed from a vehicle. The '922 patent indicates that parts of a hydraulic system are permanently mounted on the vehicle chassis and can be adapted to serve, as required, all the hydraulic motors of the detachable equipment. The '922 patent further discloses a hydraulic control arrangement that enables the vehicle operator to control any of the hydraulic equipment applied to the vehicle from a cab with a single set of control levers.

While the '922 patent provides for operation of a grader blade attachment using a single set of control levers, the '922 patent does not address the difficulty associated with controlling a grader blade attachment using the operator controls of a compact construction machine. In particular, it may be advantageous to operate multiple actuators of a machine in tandem using the same set of joystick patterns to thereby simplify control of the grader blade attachment.

The implement control system of the present disclosure solves one or more of the problems set forth above and/or other problems in the art.

SUMMARY

An implement control system includes an operator control configured for manipulation in one or more motions; and a controller configured to, based on a particular motion of the one or more motions, cause actuation of one or more first actuators, configured to selectively raise or lower a first lateral side of a work implement of a machine, and one or more second actuators, configured to selectively raise or lower a second lateral side of the work implement, in tandem.

A machine includes a linkage for attachment of a work implement; an operator control configured for manipulation in one or more motions; and a controller configured to, based on a particular motion of the one or more motions, cause actuation of one or more first actuators, configured to selectively raise or lower a first lateral side of the work implement, and one or more second actuators, configured to selectively raise or lower a second lateral side of the work implement, in tandem.

A method includes receiving, by a controller and from an operator control of a machine, a movement command associated with a motion of the operator control; and causing, by the controller and in response to the movement command, actuation of one or more first actuators, configured to selectively raise or lower a first lateral side of a work implement, and actuation of one or more second actuators, configured to selectively raise or lower a second lateral side of the work implement, in tandem.

DETAILED DESCRIPTION

Figure 1:
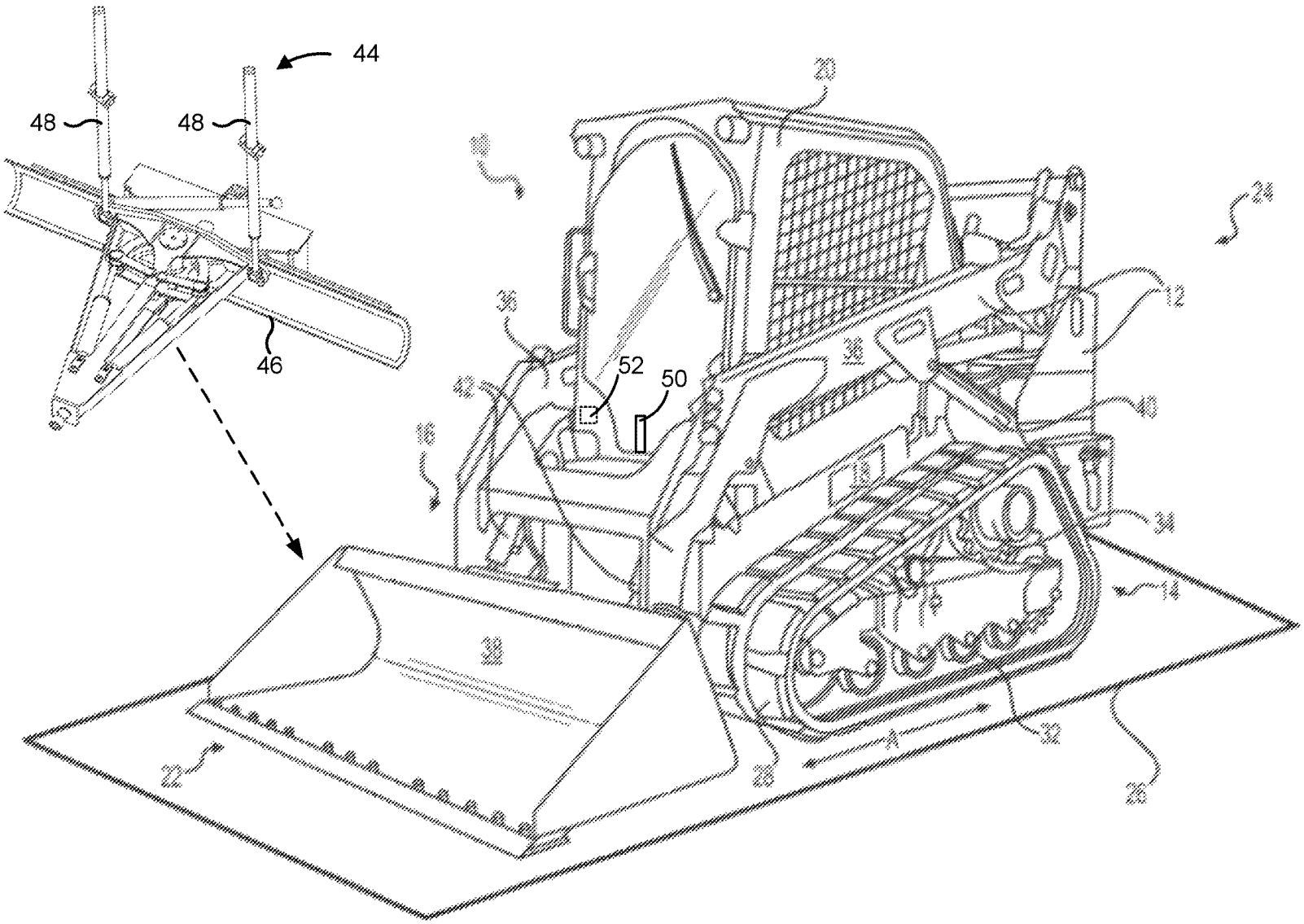
FIG. 1 is a diagram of an example machine described herein.

FIG. 1 is a diagram of an example machine 10. Machine 10 may perform earth moving, excavation, or another operation associated with an industry such as construction or mining, among other examples. For example, as illustrated in FIG. 1, machine 10 is a compact track loader. However, machine 10 may be, for example, an excavator, a paver, a dozer, a skid steer loader, a multi-terrain loader, or a compact wheel loader, among other examples. Machine 10 includes machine frame 12, undercarriage 14, work tool assembly 16, engine 18, and operator station 20. Machine 10 may be an autonomous machine, which can operate without the need for an operator to be present on machine 10. Machine 10 may be remotely controllable by an operator located off board machine 10.

Machine frame 12 extends from front end 22 to rear end 24 of machine 10. Machine frame 12 is supported on ground surface 26 by undercarriage 14, which is used to propel machine 10 in a forward or rearward direction (e.g., along arrow A). A suspension system (not shown) may be disposed between machine frame 12 and undercarriage 14. The suspension system includes, for example, one or more of springs, dampers, shock absorbers, or other suspension components.

Undercarriage 14 is configured to engage ground surface 26, such as a road or another type of terrain. Undercarriage 14 includes a pair of endless tracks 28 (only one track shown in FIG. 1) supported by one or more rollers 32. Undercarriage 14 also includes sprockets 34 that may be driven by engine 18. Rotation of sprockets 34 causes tracks 28 to propel machine 10 in the forward or rearward direction. Although machine 10 has been illustrated as having tracks 28, undercarriage 14 of machine 10 may instead include a plurality of wheels for propelling machine 10 in a forward or rearward direction. For example, undercarriage 14 of machine 10 may include a pair of front wheels disposed adjacent front end 22 of machine frame 12, and a pair of rear wheels disposed adjacent rear end 24 of machine frame 12.

Work tool assembly 16 may include lift arms 36, work implement 38, lift arm actuators 40, and tilt actuators 42. Lift arms 36 may extend from adjacent rear end 24 toward front end 22 of machine frame 12. Lift arms 36 may be pivotably connected to machine frame 12 at loader joints adjacent rear end 24 of machine frame 12. Work tool assembly 16 may be connected to and supported by machine frame 12. One or more linkages (not shown) may be disposed between lift arms 36 and machine frame 12, and the one or more linkages may connect lift arms 36 to machine frame 12. Work implement 38 may be pivotably attached to lift arms 36 at tool joints adjacent front end 22. One or more linkages (not shown) may be disposed between work implement 38 and lift arms 36, and the one or more linkages may connect work implement 38 to lift arms 36. Loader joints and tool joints may be pin joints that respectively allow lift arms 36 and work implement 38 to pivot, thereby permitting control of lift and tilt of the work implement 38. Although two lift arms 36 have been illustrated in FIG. 1, machine 10 may have any number of lift arms 36.

As shown in FIG. 1, work implement 38 may be a bucket, which may be a standard work implement for the compact track loader (or a skid steer loader) illustrated in FIG. 1. In some implementations, work implement 38 may be a shovel, a dozer blade, a box blade, or another type of work implement or tool suitable for use with machine 10. The bucket may be removable from a linkage (as described above), and replaced with another work implement. For example, work implement 38 may be a grader blade assembly 44, which is connected to the linkage after removal of the bucket. Grader blade assembly 44 includes a grader blade 46. Grader blade assembly 44 also includes a set of lift actuators 48, which pivotably connect between a support of grader blade assembly 44 and grader blade 46. The connection of grader blade assembly 44 (or another work implement 38) to the linkage of machine 10 may include mechanical connection, electrical connection, and/or hydraulic/pneumatic connection.

A first lift actuator 48 may control raising and lowering a first lateral side (e.g., a left side) of grader blade 46, and a second lift actuator 48 may control raising and lowering a second lateral side (e.g., a right side) of grader blade 46. Extending or retracting both lift actuators 48 respectively raises or lowers grader blade 46 relative to machine frame 12 and ground surface 26. Extending one lift actuator 48 while retracting the other lift actuator 48 tilts grader blade 46 (e.g., from left to right, or from right to left) relative to machine frame 12 and ground surface 26.

Lift actuators 48 may be hydraulic actuators (e.g., hydraulic cylinders, such as piston-cylinder units). In some examples, lift actuators 48 may be pneumatic actuators or other types of actuators. Lift actuators 48 may be configured for independent control. For example, each lift actuator 48 may be controlled by a respective hydraulic circuit, a respective pump, a respective hydraulic supply line, and/or a respective control valve, one or more of which may be provided on machine 10 or grader blade assembly 44.

Although a single left-side lift actuator 48 and a single right-side lift actuator 48 are illustrated in FIG. 1, grader blade assembly 44 may include any number of lift actuators 48 for each side of grader blade 46. For example, grader blade assembly 44 may include one or more lift actuators 48 for the first lateral side of grader blade 46 and one or more second lift actuators 48 for the second lateral side of grader blade 46.

As shown in FIG. 1, work tool assembly 16 includes lift arm actuators 40, which pivotably connect between machine frame 12 and lift arms 36. Selectively extending or retracting lift arm actuators 40 respectively raises or lowers lift arms 36, and consequently raises or lowers work implement 38 relative to machine frame 12 and ground surface 26. Work tool assembly 16 also includes tilt actuators 42, which pivotably connect between lift arms 36 and work implement 38. Selectively extending or retracting tilt actuators 42 rotates work implement 38 relative to lift arms 36. Thus, adjusting lift arm actuators 40 and/or tilt actuators 42 may change an inclination or angle of attack of work implement 38 relative to ground surface 26. In some implementations, lift arm actuators 40 may be fully retracted (e.g., such that lift arms 36 are resting in stops) when grader blade assembly 44 is attached to machine 10. Lift arm actuators 40 and/or tilt actuators 42 may be hydraulic actuators, pneumatic actuators, or other types of actuators, as described above.

Engine 18 is supported by machine frame 12 and is configured to generate a power output that can be directed through sprockets 34 and tracks 28 to propel machine 10 in a forward or rearward direction (e.g., along arrow A). Engine 18 may be any suitable type of internal combustion engine, such as a compression-ignition engine, a spark-ignition engine, a natural gas or alternative fuel engine, or a hybrid-powered engine, among other examples. In some implementations, engine 18 may be driven by electrical power.

Engine 18 is configured to deliver power output to sprockets 34. Additionally, or alternatively, engine 18 may be configured to deliver power output to a generator, which in turn drives one or more electric motors coupled to sprockets 34. Additionally, or alternatively, engine 18 may be configured to deliver power output to a hydraulic motor fluidly coupled to a hydraulic pump and configured to convert a fluid pressurized by the hydraulic pump into a torque output, which is directed to sprockets 34. Engine 18 also is configured to provide power to move work tool assembly 16. For example, engine 18 may provide power to one or more hydraulic pumps that provide pressurized fluid to one or more of lift actuators 48, lift arm actuators 40, and/or tilt actuators 42 to move work implement 38. As an example, engine 18 may provide power to one or more hydraulic pumps that provide pressurized fluid to lift actuators 48 to move grader blade 46.

Operator station 20 is supported on machine frame 12. Operator station 20 may be an open or an enclosed compartment. Operator station 20 includes operator control 50. Operator control 50 includes an input device for operating and/or driving machine 10. Operator control 50 is configured for manipulation (e.g., by an operator) in one or more motions (e.g., a forward motion, a rearward motion, a leftward motion, a rightward motion, and/or motions therebetween). A particular motion performed by operator control 50 may control actuation of lift actuators 48 in tandem (e.g., the lift actuators 48 are actuated together, such as concurrently), as described below. Operator control 50 may be a joystick (e.g., a single-axis joystick or a multiple-axis joystick), a lever, or a knob, among other examples. Operator station 20 may include one or more additional operator controls for performing other operations of machine 10.

Furthermore, operator station 20 may include one or more additional controls for selecting operations and/or operating modes of machine 10. For example, operator station 20 may include a selector input (shown in FIG. 2 as a selector input 54) for selecting between different operating modes of machine 10. As an example, the selector input may be one or more buttons, switches, and/or toggles, among other examples. For example, the selector input may be one or more buttons on a joystick used for operator control 50. The selector input is configured to toggle operator control 50 between a tandem operation mode (e.g., a first mode), in which operator control 50 controls the first lift actuator 48 and the second lift actuator 48 in tandem, and an independent operation mode (e.g., a second mode) in which operator control 50 controls the first lift actuator 48 or the second lift actuator 48 independently. In addition, operator station 20 may include one or more display devices (e.g., touch screen devices) for conveying information to an operator and/or providing a user interface for the operator. In some implementations, the selector input may be one or more selectable icons of the one or more display devices.

As shown in FIG. 1, the operator station 20 may include a controller 52 (e.g., an electronic control module (ECM)). However, controller 52 may be located at another part of machine 10 or may be located remotely from machine 10. Controller 52 may include one or more memories and/or one or more processors that implement operations associated with coordinated actuator control by operator control 50, as described in connection with FIG. 2. For example, controller 52 may be configured to receive a movement command associated with a motion of operator control 50, and cause, in response to the movement command, actuation of the first lift actuator 48 and actuation of the second lift actuator 48 in tandem.

As indicated above, FIG. 1 is provided as an example. Other examples may differ from what is described with regard to FIG. 1.

Figure 2:
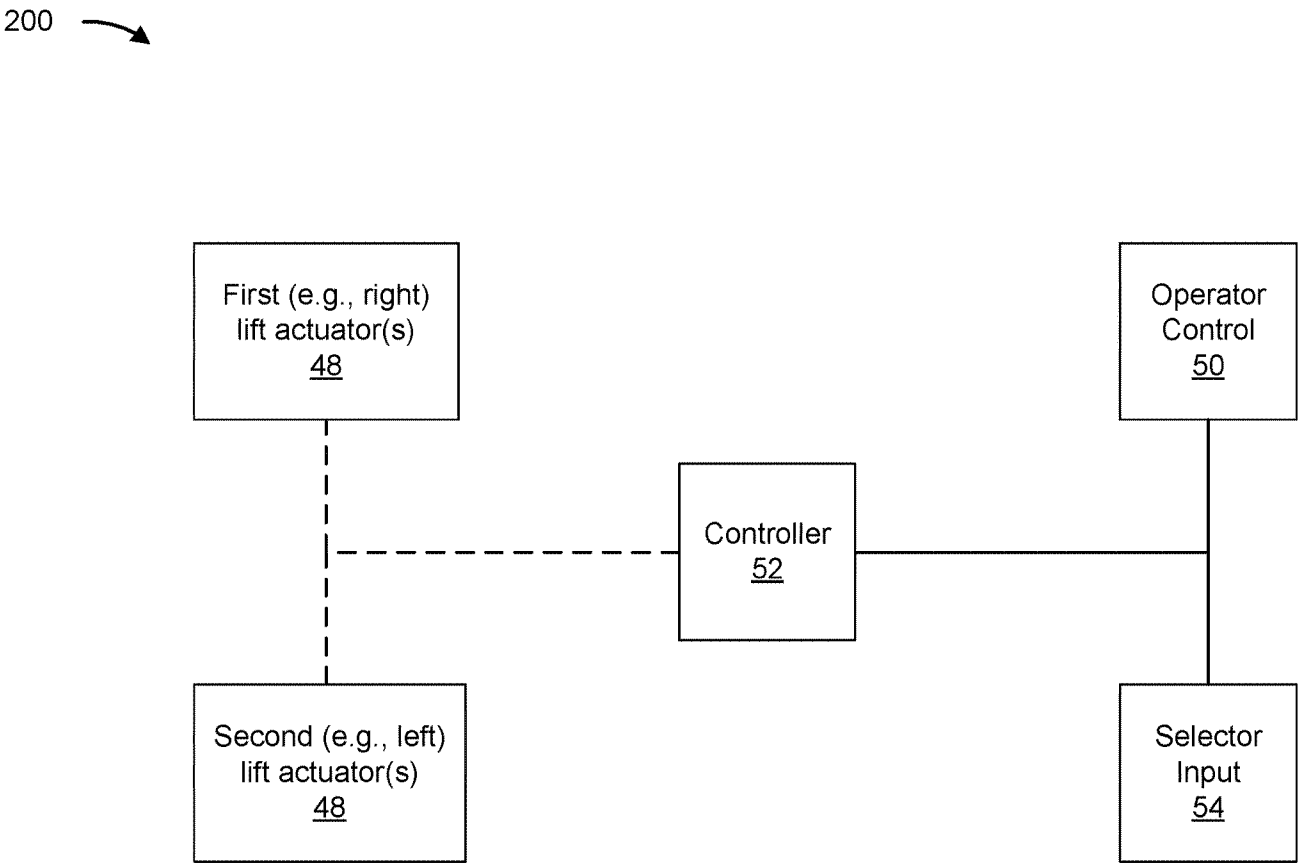
FIG. 2 is a diagram of an example implement control system described herein.

FIG. 2 is a diagram of an example implement control system 200. As shown, the implement control system 200 includes controller 52, one or more first lift actuators 48 (e.g., one or more first actuators configured to selectively raise or lower a first lateral side of work implement 38), one or more second lift actuators 48 (e.g., one or more second actuators configured to selectively raise or lower a second lateral side of work implement 38), operator control 50, and/or selector input 54. Implement control system 200, in response to the same motion of operator control 50, may provide actuation of the first (e.g., right) and second (e.g., left) lift actuators 48 in tandem when machine 10 is operating in a tandem operation mode. In this way, implement control system 200 facilitates improved control of work implement 38 (e.g., grader blade assembly 44).

Controller 52 may determine an operating mode for implement control system 200 (e.g., for machine 10). The operating mode may be the tandem operation mode or the independent operation mode. In the tandem operation mode, motions of operator control 50 control actuation of the first and second lift actuators 48 in tandem. In the independent operation mode, the same motions of operator control 50 control actuation of either the first lift actuator 48 or the second lift actuator 48 independently. For example, in the tandem operation mode, a forward motion of a joystick used for operator control 50 may cause extension of both the first and second lift actuators 48 together to lower work implement 38 (e.g., in a parallel movement), a rearward motion of the joystick may cause retraction of both the first and second lift actuators 48 together to raise work implement 38, a rightward motion of the joystick may cause the first lift actuator 48 to extend and the second lift actuator 48 to retract together to rightward tilt (e.g., rightward roll) work implement 38, and a leftward motion of the joystick may cause the first lift actuator 48 to retract and the second lift actuator 48 to extend together to leftward tilt work implement 38. Continuing with the previous example, in the independent operation mode, the same forward motion of the joystick may cause only the first lift actuator 48 to extend, the same rearward motion of the joystick may cause only the first lift actuator 48 to retract, the same rightward motion of the joystick may cause only the second lift actuator 48 to extend, and the same leftward motion of the joystick may cause only the second lift actuator 48 to retract.

Controller 52 may autonomously determine the operating mode for implement control system 200. That is, controller 52 may determine a selection of the tandem operation mode or the independent operation mode for implement control system 200. Controller 52 may determine the operating mode based on information associated with ground surface 26 (e.g., a detected, or a configured, terrain type of ground surface 26), information associated with movements and/or operation of work implement 38 (e.g., a distance between work implement 38 and ground surface 26, and/or a load on work implement 38, among other examples), information associated with a type of task being performed, and/or information associated with a work plan for a task being performed, among other examples. For example, controller 52 may determine the operating mode based on information received from one or more sensors on machine 10.

In some implementations, controller 52 may determine the tandem operation mode for implement control system 200 based on an identity of work implement 38. For example, upon connection of work implement 38 to machine 10, controller 52 may receive, from work implement 38, information relating to an identity of work implement 38, and controller 52 may determine whether to select the tandem operation mode for the operating mode based on the information. As an example, upon connection of grader blade assembly 44 to machine 10, controller 52 may determine the tandem operation mode for the implement control system 200 based on information indicating that a grader blade assembly is attached to machine 10.

Controller 52 may determine the operating mode for implement control system 200 based on a user selection. For example, an operator may select between the tandem operation mode and the independent operation mode using selector input 54. Accordingly, controller 52 may receive the user selection of the tandem operation mode or the independent operation mode from the selector input 54.

Controller 52 may receive a movement command (e.g., an electrical signal) from operator control 50. The movement command may be associated with a particular motion of operator control 50. For example, controller 52 may receive a first movement command associated with a forward motion of the joystick or a second movement command associated with a rearward motion of the joystick. Accordingly, the movement command may indicate a direction of the particular motion of operator control 50, a degree (e.g., a percentage) of the particular motion of operator control 50 in the direction, or the like.

Controller 52 may determine whether to cause tandem actuation of the first lift actuator 48 and the second lift actuator 48, or whether to cause independent actuation of the first lift actuator 48 or the second lift actuator 48, in response to the movement command. Controller 52 may determine whether to cause the tandem actuation or the independent actuation based on the operating mode (e.g., autonomously determined by the controller 52 or indicated by a user selection). For example, controller 52 may determine to cause tandem actuation of the first lift actuator 48 and the second lift actuator 48 when the operating mode is the tandem operation mode. As another example, controller 52 may determine to cause independent actuation of the first lift actuator 48 or the second lift actuator 48 when the operating mode is the independent operation mode.

Controller 52 may selectively cause actuation of the first lift actuator 48 and/or the second lift actuator 48 in response to the movement command and based on the operating mode. In the tandem operation mode, controller 52 may cause actuation of the first lift actuator 48 and the second lift actuator 48 in tandem in response to a particular motion of operator control 50 (e.g., the joystick). For example, controller 52 may cause tandem actuation of the first lift actuator 48 and the second lift actuator 48 in the same direction. That is, controller 52 may cause the first lift actuator 48 and the second lift actuator 48 to extend in tandem or to retract in tandem. As another example, controller 52 may cause tandem actuation of the first lift actuator 48 and the second lift actuator 48 in different directions. That is, controller 52 may cause the first lift actuator 48 to extend and the second lift actuator 48 to retract in tandem, or cause the first lift actuator 48 to retract and the second lift actuator 48 to extend in tandem.

The first lift actuator 48 may be controlled by a first control system, and the second lift actuator 48 may be controlled by a second control system. The first control system and the second control system may be independent. For example, the first control system may include one or more first actuator control valves for controlling the first lift actuator 48, and the second control system may include one or more second actuator control valves for controlling the second lift actuator 48. That is, the first and second control systems may include separate actuator control valves (e.g., configured for independent control), thereby enabling independent control of the first lift actuator 48 and the second lift actuator 48 (e.g., in contrast to multiple actuators controlled by the same control valve, such that independent control is not possible). The first and second control systems may include separate control circuits (e.g., hydraulic circuits), separate pumps (e.g., hydraulic pumps), and/or separate supply lines (e.g., hydraulic supply lines). Alternatively, the first and second control systems may share one or more pumps and/or supply lines, provided that the first and second control systems permit independent control of the first lift actuator 48 and the second lift actuator 48 (e.g., by using separate actuator control valves for the first lift actuator 48 and the second lift actuator 48).

Controller 52 may cause tandem actuation of the first and second lift actuators 48 by controlling (e.g., via electrical signals), in tandem, the first and second actuator control valves to adjust the flow of, for example, hydraulic fluid to control the rate and direction of movement of the first and second lift actuators 48. Machine 10 may include the first and second control systems, or a portion thereof, and/or work implement 38 (e.g., grader blade assembly 44) may include the first and second control systems or a portion thereof. For example, machine 10 may include the first and second actuator control valves for the first and second lift actuators 48. As another example, work implement 38 (e.g., grader blade assembly 44) may include the first and second actuator control valves for the first and second lift actuators.

In this way, a motion of a single operator control 50 (e.g., a single joystick) may control, in tandem, actuation of a first actuator associated with a first control valve or control circuit and actuation of a second actuator associated with a second control valve or control circuit. In other words, the first actuator and the second actuator are configured for independent control via separate control valves/circuits, but may be operated in tandem by a particular motion of operator control 50 (e.g., the joystick). While the first actuator and the second actuator are described above using an example of lift actuators 48, other examples are contemplated. For example, the first and second actuators may be actuators of work implement 38 (e.g., grader blade assembly 44) or machine 10 configured for tilt (e.g., rotational) movement of work implement 38, fore and aft movement of work implement 38, or the like. In some implementations, the first and second actuators may control skid shoes of a cold planar machine, may control stabilizer arms of a machine, or the like.

As indicated above, FIG. 2 is provided as an example. Other examples may differ from what is described with regard to FIG. 2.

Figure 3:
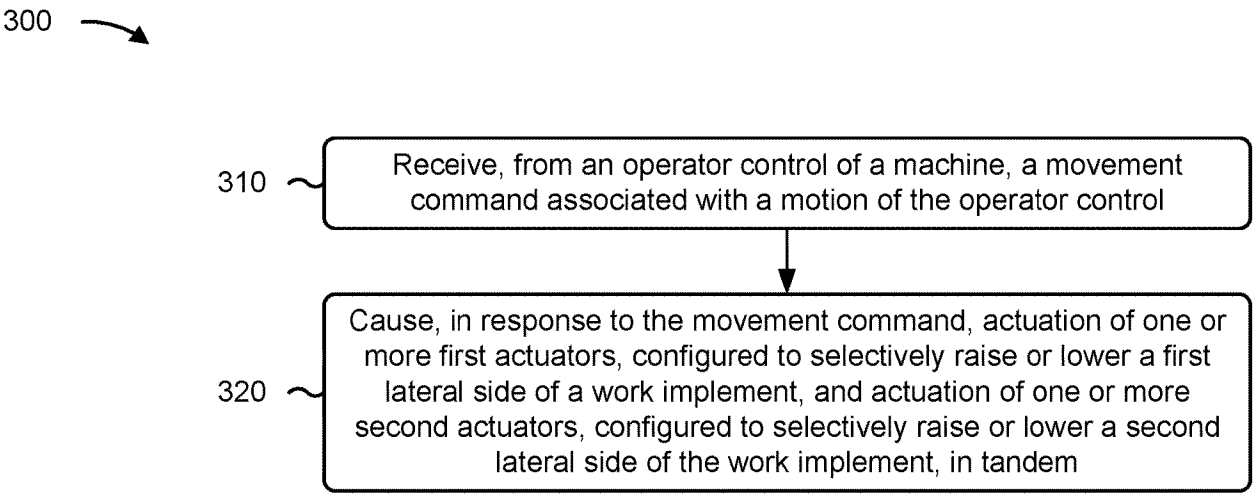
FIG. 3 is a flowchart of an example process relating to coordinated actuator control by an operator control.

FIG. 3 is a flowchart of an example process 300 associated with coordinated actuator control by an operator control. One or more process blocks of FIG. 3 may be performed by a controller (e.g., controller 52). Additionally, or alternatively, one or more process blocks of FIG. 3 may be performed by another device or a group of devices separate from or including the controller, such as another device or component that is internal or external to machine 10.

As shown in FIG. 3, process 300 may include receiving, from an operator control of a machine, a movement command associated with a motion of the operator control (block 310). For example, the controller may receive, from an operator control of a machine, a movement command associated with a motion of the operator control, as described above. The operator control may be a joystick.

As further shown in FIG. 3, process 300 may include causing, in response to the movement command, actuation of one or more first actuators configured to selectively raise or lower a first lateral side of a work implement, and actuation of one or more second actuators configured to selectively raise or lower a second lateral side of the work implement, in tandem (block 320). For example, the controller may cause, in response to the movement command, actuation of one or more first actuators configured to selectively raise or lower a first lateral side of a work implement, and actuation of one or more second actuators configured to selectively raise or lower a second lateral side of the work implement, in tandem, as described above. The one or more first actuators and the one or more second actuators may be connected to the work implement. The work implement may be a grader blade. The one or more first actuators and the one or more second actuators may be controlled by independent control systems. For example, the one or more first actuators may be controlled by a first control valve and the one or more second actuators may be controlled by a second control valve.

Causing actuation of the one or more first actuators and the one or more second actuators may include causing the one or more first actuators and the one or more second actuators to extend in tandem or retract in tandem. Alternatively, causing actuation of the one or more first actuators and the one or more second actuators may include causing the one or more first actuators to extend, and the one or more second actuators to retract, in tandem.

Causing actuation of the one or more first actuators and actuation of the one or more second actuators in tandem may be based on a determination that the machine is operating in a first mode. Process 300 may further include receiving, from the operator control, an additional movement command associated with the motion of the operator control, and causing, in response to the additional movement command, actuation of the one or more first actuators or actuation of the one or more second actuators independently based on a determination that the machine is operating in a second mode.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The disclosed implement control system 200 may be used with any machine 10 where coordinated actuator control by an operator control 50 is desired. For example, the implement control system 200 may be used with a compact track loader or a skid steer loader that is using a grader blade attachment.

Implement control system 200 may provide control of multiple actuators in tandem. For example, implement control system 200 may provide tandem control of right and left lift actuators 48 of a grader blade assembly 44. The right and left lift actuators 48 may be controlled in tandem by a single operator control 50, such as a joystick, when machine 10 is operating in a tandem operation mode. In this way, a single particular motion of operator control 50 may control actuation of the right and left lift actuators 48 in tandem. This provides more intuitive joystick patterns, and thereby facilitates improved control of a work implement 38. Accordingly, the control of complex movements of work implement 38 may be simplified. For example, an operator may raise, lower, right tilt, or left tilt a grader blade 46 using a single motion of the joystick. As a result, grading operations may be performed faster and with reduced operator error.

The foregoing disclosure provides illustration and description, but is not intended to be exhaustive or to limit the implementations to the precise form disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. An implement control system, comprising:
an operator control configured to be manipulated in a set of motions to cause movement of a work implement of a machine; and
a controller configured to:
determine, based on an identity of the work implement, a selection of a tandem operation mode or an independent operation mode,
wherein, when the implement control system is in the tandem operation mode, a motion, of the set of motions, causes concurrent movement of a first actuator of the work implement and a second actuator of the work implement, and
wherein, when the implement control system is in the independent operation mode, the motion causes movement of only one of the first actuator or the second actuator, and
based on selection of the tandem operation mode and based on the motion, cause concurrent actuation of the first actuator and the second actuator to selectively raise or lower at least one side of the work implement.

2. The implement control system of claim 1, further comprising:
a first control valve for the first actuator; and
a second control valve for the second actuator.

3. The implement control system of claim 1, wherein the operator control comprises a multiple-axis joystick.

4. The implement control system of claim 1, wherein the work implement comprises a grader blade.

5. The implement control system of claim 1, wherein the controller, when causing the concurrent actuation of the first actuator and the second actuator, is configured to cause actuation of the first actuator and actuation of the second actuator in a same direction.

6. The implement control system of claim 1, wherein the controller, when causing the concurrent actuation of the first actuator and the second actuator, is configured to cause actuation of the first actuator and actuation of the second actuator in different directions.

7. The implement control system of claim 1, further comprising:
the work implement.

8. A machine, comprising:
a work implement;
an operator control configured to be manipulated in a set of motions; and
a controller configured to:
determine, based on information associated with a ground surface, information associated with operation of the work implement, or information associated with a type of task being performed, a selection of a tandem operation mode or an independent operation mode,
wherein, when the machine is in the tandem operation mode, a motion, of the set of motions, causes concurrent movement of a first actuator of the work implement and a second actuator of the work implement, and
wherein, when the machine is in the independent operation mode, the motion causes movement of only one of the first actuator or the second actuator, and
based on selection of the tandem operation mode and based on the motion, cause actuation of the first actuator and the second actuator to selectively raise or lower at least one side of the work implement.

9. The machine of claim 8, wherein the work implement comprises a grader blade.

10. The machine of claim 8, wherein the operator control comprises a knob.

11. The machine of claim 8, wherein the work implement is connected to the machine at a linkage.

12. The machine of claim 8, further comprising:
a first control system for the one or more first actuators; and
a second control system for the one or more second actuators.

13. The machine of claim 8, wherein the first actuator is controlled by a first control valve, and the second actuator is controlled by a second control valve.

14. The machine of claim 8, wherein the machine is a compact track loader or a skid steer loader.

15. A method, comprising:

receiving, by a controller and from an operator control of a machine, a movement command associated with a motion of the operator control;

determining, by the controller, a selection of a tandem operation mode or an independent operation mode, wherein, when the machine is in the tandem operation mode, the motion causes concurrent movement of a first actuator and a second actuator of a work implement, and wherein, when the machine is in the independent operation mode, the motion causes movement of only one of the first actuator or the second actuator; and causing, by the controller, in response to the movement command, and based on selection of the tandem operation mode, concurrent actuation of the first actuator and the second actuator to selectively raise or lower at least one side of the work implement.

16. The method of claim 15, wherein the method further comprises:

receiving, from the operator control, an additional movement command associated with the motion of the operator control; and causing, in response to the additional movement command and based on selection of the independent operation mode, actuation of the first actuator or actuation of the second actuator independently.

17. The method of claim 15, wherein the first actuator is controlled by a first control valve, and the second actuator is controlled by a second control valve.

18. The method of claim 15, wherein causing concurrent actuation of the first actuator and the second actuator comprises:

causing the first actuator and the second actuator to extend in tandem or retract in tandem.

19. The method of claim 15, wherein causing concurrent actuation of the first actuator and the second actuator comprises:

causing the first actuator to extend, and the second actuator to retract, in tandem.

20. The method of claim 15, wherein determining the selection of the tandem operation mode or the independent operation mode is based on one of:

an identity of the work implement, information associated with a ground surface, information associated with operation of the work implement, information associated with a type of task being performed, or a user selection via a selector input.

* * * * *